US006626805B1

(12) United States Patent
Lightbody

(10) Patent No.: US 6,626,805 B1
(45) Date of Patent: Sep. 30, 2003

(54) EXERCISE MACHINE

(76) Inventor: William S. Lightbody, 32600 Fairmount Blvd., Pepper Pike, OH (US) 44124

( * ) Notice: Subject to any disclaimer, the term of this patent is extended or adjusted under 35 U.S.C. 154(b) by 0 days.

(21) Appl. No.: 07/491,274

(22) Filed: Mar. 9, 1990

(51) Int. Cl.[7] ..... A63B 21/00
(52) U.S. Cl. ..... 482/69
(58) Field of Search ..... 272/129, 130, 272/93, DIG. 5, 118; 482/6, 9, 5, 94, 99, 100, 132, 133, 137, 901, 902, 136; 73/379.01, 379.06, 379.08

(56) References Cited

U.S. PATENT DOCUMENTS 4,261,562 A * 4/1981 Flavell ..... 482/6
4,542,897 A * 9/1985 Melton et al. ..... 482/8
4,609,189 A * 9/1986 Brasher ..... 482/5 X
4,674,741 A * 6/1987 Pasierb, Jr. et al. ..... 482/6 X
4,708,337 A * 11/1987 Shyu ..... 482/1 X
4,730,829 A * 3/1988 Carlson ..... 272/129
4,746,113 A * 5/1988 Kissel ..... 272/118
4,765,613 A * 8/1988 Voris ..... 272/129
4,778,175 A * 10/1988 Wucherpfennis et al. ... 272/129
4,817,940 A * 4/1989 Shaw et al. ..... 272/93
4,822,036 A * 4/1989 Dang ..... 482/6
4,828,257 A * 5/1989 Dyer et al. ..... 272/129
4,842,266 A * 6/1989 Sweeney, Sr. et al. ..... 482/54
4,848,738 A * 7/1989 Mueller ..... 482/98
4,869,497 A * 9/1989 Stewart et al. ..... 482/9 X
4,919,418 A * 4/1990 Miller ..... 482/6
4,921,244 A * 5/1990 Berroth ..... 482/94
4,930,770 A * 6/1990 Baker ..... 482/95
4,934,692 A * 6/1990 Owens ..... 272/129 X
4,989,861 A * 2/1991 Halpern ..... 482/5
5,011,142 A * 4/1991 Eckler ..... 482/5
5,020,794 A * 6/1991 Englehardt et al. ..... 482/9 X
5,037,089 A * 8/1991 Spagnuolo et al. ..... 272/129
5,117,170 A * 5/1992 Keane et al. ..... 482/5 X

* cited by examiner

*Primary Examiner*—Glenn E. Richman
(74) *Attorney, Agent, or Firm*—Light body & Lucas

(57) ABSTRACT

In an exercise machine having a weight type resistance for use with a repetitive exercise having a desired parameter such as time per repetition or desired heart rate of the exerciser, the improvement of means to determine the actual values of the parameter and to then automatically continually adjust the value of the resistance so as to keep the exercise within the desired parameter within acceptable values. The means also imparts an inertial quality to the resistance.

69 Claims, 4 Drawing Sheets

EXERCISE MACHINE

FIELD OF THE INVENTION

This invention relates to an improved exercise machine utilizing inertial loads, positive control, and bio-feedback.

BACKGROUND OF THE INVENTION

Exercise machines come in various forms. The most popular type of exercise machines currently include the Nautilus system (a system using weight blocks and cams to exercise various specific muscle groups on specialized machines) and exercising machines such as air fan resistance stationary bicycles like the RANDALL WIND RACER, air fan resistance stationary rowing machine like, the CONCEPT II ERGOMETER, and air fan resistance stationary bicycles like the STAIRMASTER (devices that exercise more general muscle groupings and provide aerobic conditioning). Although some of the exercising machines can utilize variable loadings, these loadings are normally only the machines preprogrammed workout-levels. The consumer must therefore normally accept the exercising of specialized muscles bidirectionally (resistance machines like NAUTILUS machines), or a more complete general workout without bidirectionally or much individual control (the other named machines).

This present invention is directed to providing an exercising machine combining both specific and general conditioning with feedback and inertial load capabilities.

SUMMARY OF THE INVENTION

The present invention is directed to providing an exercising machine utilizing inertial load capabilities.

It is an object of this invention to increase the effectiveness of exercising machines.

It is an object of this invention to increase the longevity of exercising machines.

It is an object of this invention to allow for the incorporation of feedback into exercising machines.

It is an object of this invention to reduce the cost of exercising machines.

It is an object of this invention to reduce the size of exercising machines.

Other objects and a more complete understanding of the invention may be had by referring to the following description and drawings in which:

DESCRIPTION OF THE PREFERRED EMBODIMENT

Figure 7:
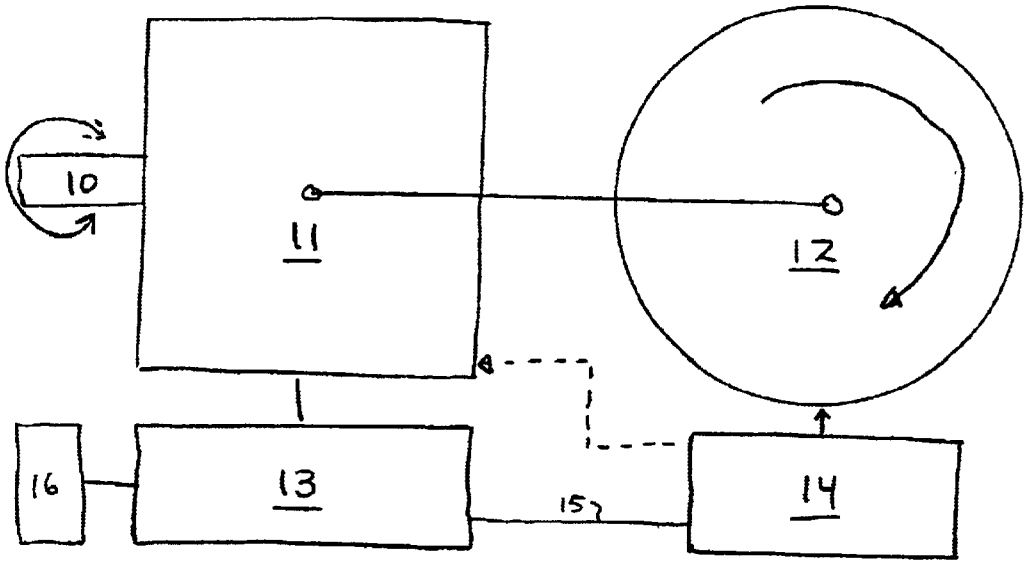
FIG. 7 is a conceptual description of the invention.

This invention relates to an improved exercising machine. A generic description of a preferred embodiment of the invention is shown in FIG. 7. In this figure there is a repetitive input of force 10 into a controllable variable resistance 11. The repetitive force 10 may or may not be bidirectional depending upon the particular muscle group being exercised. For example with a bicycle machine having pedal input as the repetitive force 10, the repetitive force 10 would be the unidirectional pedalling force occasioned by the exerciser. However if the force 10 was resultant from a back press resistance machine, the force would be bidirectional—a positive force when the exerciser moves his back against the resistance (weights) and the negative force which occurs as the exerciser returns to his original position holding back against the now positive force of the previous resistance. The controllable variable resistance 11 takes the force 10 and utilizes it by driving or moving a load 12. Preferably this load has an inertial quality to it. This would provide the exerciser with an additional personally controlled parameter that can be manipulated independently of the machine (if desired). For example a resistance exerciser like a NAUTILUS machine incorporating this additional parameter would allow the exerciser to accomplish the exercise repetition quickly at a high but uneven effort or more slowly at a lower but even effort (while retaining the same overall time per repetition). Note that since it is easier to work against a reducing resistance, it is preferred that the machine be initially set for a high resistance in an automatic universal mode, reducing it as necessary to match the exerciser (beginning with a lower resistance, although harder to control, may be more satisfying to some users who need to feel a sense of accomplishment early on). In the embodiment of FIG. 7 the load 12 is a preset inertial fan having both flywheel and resistance capabilities. This particular load is suitable most specially for a unidirectional force such as that produced by a bicycle machine having a pedal input. With other types of exercising equipment, other loads might be selected (such as variable resistances, weights, flywheels, springs, motors, etc.). (Note that in the instance of a bidirectional force combined with an inertial type load it may be desirable to install a reverse drive mechanism and a forward/reverse clutch or some kind of a reverse load, such as a motor, into the resistance 11 such that power or resistance can be returned to the exerciser on the return stroke—for example in a manner similar as occurs with the weights of an exercising machine like in the NAUTILUS system.)

The effective strength (and reversibility if appropriate) of the controllable variable resistance 11 is under the control of a separate control box 13. This control box 13 is preferably programmed with the desired exercise coefficients that the particular exerciser or machine designer deems appropriate. The programming can be preset into the machine, entered by a keyboard or card, or otherwise determined. The exercise set by the programming can vary parameters both during the exercise and between modes of the exercise. (For example in a bidirectional exercise vary the effective weight while also loading the return stroke differently than the forward stroke.) Preferably the programming would be set to optimize a particular exercise. This would provide the exerciser with a certainty that the particular exercise was being accomplished as intended. This avoids undue strain on the exerciser while also acting to provide an optimal exercise. This programming can easily be provided by creating a base program suitable for the "typical" exerciser. This base program can be created empirically (by actually measuring the parameters of the exercise while a number of persons are accomplishing it and then placing these parameters or some sort of summary thereof into the control box 13 as a look up table or reference program for other persons) or theoretically (by computing the optimum parameters for the exercise and using these optimum parameters or some sort of summary thereof in the look up table or reference program for other persons). It is preferred that the exerciser have a choice of differing parameters at least available. For example, if the exerciser wants to have a continual resistance of a known quantity, the exerciser merely programs the control to provide such perimeters. (An example of this would be an individual who wants to work against a constant 100 pound force.) If on the other hand, the exerciser wants to have a long rhythmic resistance whereby the resistance is small at the beginning but then increases based on the time the force 10 is continued to be applied, the control 13 can easily be programmed to provide such a control. (An example of this would be an individual who wants a force beginning at ten pounds and then increasing logarithmically to 100 pounds at the very end of the exercise travel for the machine.) Other types of control are in addition possible (some described later) including the total removal of resistance (for example on a back return stroke of a machine). Note also that if the force 10 is a bidirectional force, the controllable variable resistance 11 may include an automatic reversing feature such that the resistance effectively remains unidirectional irrespective of the bidirectional input therein. The reversibility is easily provided by a sliding gear in respect to a mechanical resistance or a double pull double throw switch in respect to an electrical resistance. This reversibility would be especially helpful in the event of a flywheel type resistance.

In an added refinement of the concept of FIG. 7, an altering mechanism 14 would be utilized interconnected to the controllable variable resistance 11 on load 12 to directly alter the base line of the exercise. This would be especially helpful if the load for the controllable variable resistance 11 was itself relatively non-adjustable. An example of this would be if the load was a non-adjustable weight stack in a NAUTILUS machine or other not easily changed resistance. The altering mechanism 14 would preferably be under the control of the control mechanism 13 to provide an additional variable parameter by a control line 15 for the controllable variable resistance 11. This altering mechanism 14 could be utilized as a feedback mechanism for the force 10, it could be utilized to modify the load for the exerciser at particular moments in the exercise cycle, or otherwise utilized as appropriate. An example of this motor could be utilized as an altering mechanism 14 to reduce (or increase) the effective resistance felt by the exerciser at various points during the exercise cycle. This example would allow the machine to provide a varying load with an otherwise constant resistance by effectively using the motor to add to or subtract from such resistance—i.e. to vary the resistance over time in a predetermined manner. This would allow an individual to change the exercise parameters of an exercising machine like a NAUTILUS machine, for example to feature one specific muscle over another muscle or to vary the resistance curve set by the cams in the machine. It would also allow an override should, for example, the machine move too quickly at high settings (i.e. the exerciser has difficulties with a return stroke) or too slowly at any setting (i.e. the exerciser has set the machine load himself but with too much weight). The various parameters of alteration could be set individually or be programmed in. The motor could also be utilized in conjunction with a sensor to match the workout with certain preset parameters. An example of this would be for the motor to increase (or reduce) an otherwise constant resistance to maintain the exerciser's heart rate within certain preset limits—i.e. to maintain the period of an exerciser's accomplishment of a repetitive task within the predetermined limits of a certain parameter or set of parameters. (Whether such task is the time to move a 100 pound weight one foot or to move the pedal of a bike one revolution). Note that if the control box 13 is programmed with a time per movement or repetition or other such relatively known or determinable parameter as a primary factor, it would be possible to provide for many users with but one setting. For example with the control box 13 set for a time per repetition of four seconds (two seconds out, two seconds return) and the box 13 also set to control the resistance as necessary to accomplish this, no further settings or adjustments are necessary to allow either a light user (who might only be able to do ten such repetitions at 50 pounds total resistance), or the heavy user (who might be able to do twenty repetitions at 200 pounds total resistance), or both to use the machine—i.e. the machine would automatically adjust the resistance to keep the time per repetition within the four second parameter for both users by matching the resistance to the user. Preferably the exercise machine would accomplish this adjustment by measuring the degree of difficulty that the exerciser is having with the resistance. While direct measurements of individual effort are preferred (i.e. blood pressure change, heart rate change, electrical muscle activity change, etc.), these direct measurements utilize sensors and complicated electronics that can fail or become maladjusted. It is thus far easier to utilize indirect exercise dependent measurements (such as the suggested time) that need no personal sensors or complicated electronics. The control box 13 would in any event be programmed to match the resistance to the parameter(s). For example with the parameter four seconds per repetition, the control box would be programmed to alter the resistance until the exerciser is able to move such resistance at a set rate of movement corresponding to the four second repetition (i.e. so many linear inches per second). With heart rate as the parameter, the control box 13 would likewise alter the resistance until the exerciser is within the desired range. Although the resistance once set could thereafter remain constant for the particular exerciser, the machine would preferably alter this resistance continually through the ongoing exercise to enable the exerciser to maintain the workout within the designated parameters (in the example instance with time as a parameter normally reduce the resistance as the exerciser tires during successive repetitions). A feedback indicator 16 (a series of lights or a changing tone for example) would inform the exerciser of his or her success in maintaining the desired rate of exercise (in the example instance, the four second repetition rate). An analog feedback is preferred for being easier to comprehend. Note that the exercise parameters could also be varied over time—in the example instance beginning with a rate of four seconds per repetition and end at a fate of sixteen seconds per repetition (i.e. tired exerciser); or beginning with the resistance needed to produce four seconds per repetition and ending with a 250 pound resistance (hard to do). This would be particularly pertinent to an exercise machine using resistances (as in a NAUTILUS machine) incorporating the invention as this increasing time is a natural phenomenon repetitive exercise as in a NAUTILUS machine. Thus both the nature and amount of measurement could be varied if desired. (Note, however, that the use of a single preset measurement and/or quality of exercise provides a simplicity and universality of use—i.e. the machine would need no setup to accommodate many different users.)

In an example use of FIG. 7, the exerciser would position his/herself on the machine and lightly strain against the solid resistance of the machine. The exerciser would then feel the resistance reducing as the machine seeks to produce the desired exercise level. Quickly the exerciser would be moving the machine against the resistance at the desired level (with both exerciser and machine working to maintain such level). (Note that if desired a strain gauge could be utilized to sense the exerciser's initial effort or a personalized memory/body weight look up chart could be consulted to provide an initial range of suitable resistance—i.e. provide a quick path to near the desired resistance. This would speed the initial set up of the machine for that individual.) The feedback 16 would inform the exerciser of success or failure. The exerciser would thus obtain the level of exercise suitable for the individual at that particular time irrespective of that individual's then condition, tiredness, etc. This would provide a quality not present in exercising machines. In addition due to the universality of the machine's initial set up, no individual adjustment would be necessary for multiple exercisers to use the machine (unless individual programming desired). This would allow an exerciser to move from machine to machine quickly with no concern for the various machine's previous settings. This would speed the exercising process.

Figure 8:
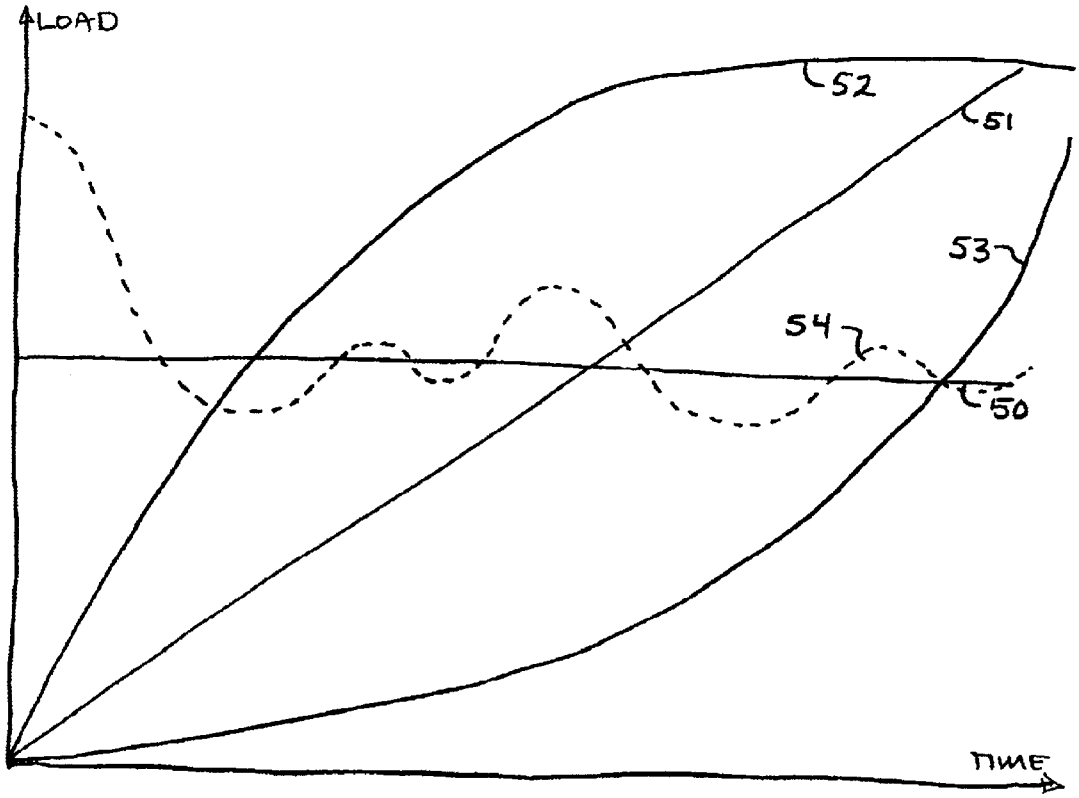
FIG. 8 is a graph of some of the alterations to resistance possible with the invention of the application.

FIG. 8 graphs various resistance curves possible with the invention. Line 50 is a constant resistance. Line 51 is a constantly increasing resistance. Line 52 is a logarithmically inverse loading. Line 53 is a logarithmically positive loading. These lines 50–53 denote typical parameters that can be preset into the control box 13. The line 54 is constantly varying to recognize the changing resistance that may be necessary to maintain compliance between a particular exerciser's performance and the parameter programmed into the machine. For example in order to retain a particular exerciser's time per repetition to be constant on a NAUTILUS resistance exercise machine. The resistance is therefore varied to accomplish this. Note that the inclusion of other factors (such as inertia into a machine) would provide additional variables (such as the difference of speed of the applied force between successive routines) to the actual programming.

Normally there would be a certain curve of resistance preset into the machine, which resistance would then be varied by the motor in order to conform the exercise to the desired parameters. The resistance preset would preferably be the median for the exercisers that would utilize the machine—i.e. the most common type of exercise curve. This preset resistance would then be varied by the motor in order to provide the desired exercise. In an added refinement a number of certain presets (for example light, medium, and heavy) would be provided. The applicant notes that while this use of a motor to vary the resistance would decrease the efficiency of the exercising machine (i.e. the electric power for the motor may consume more power than the exerciser is generating resulting in a net loss of power), the addition of the control over the exercise parameters is worthwhile under certain circumstances. (The motor could also be disengaged if desired.)

Figure 6:
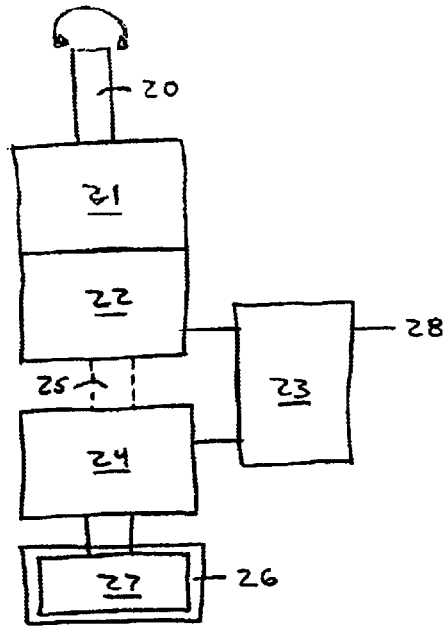
FIG. 6 is a side representational view of a feedback embodiment of the invention.

FIG. 6 discloses a compact practical arrangement for the parts of an embodiment of the invention using what effectively is an electric controllable variable resistance. In this embodiment of FIG. 6, the force 10 is produced on an input shaft 20 (bidirectional force shown). This bidirectional input shaft is interconnected to a generator 21 and a feedback motor 22. The generator 21 translates the force on the bidirectional shaft 20 into electricity, which represents in electrical terms the force on the bidirectional shaft 11. The generator is thus the sensor for this particular device. As discussed other sensors could also be utilized (torque sensors, force sensors, individual condition sensors, individual weight sensors, etc.). The electricity in turn is fed through a control box 23 to a drive motor 24. In this it is preferred that the control box 23 utilize direct current because direct current is more amenable to reliable electronic manipulation than alternating current. The motor 24 in turn drives a resistance 26, in this case a series of paddles 27 driving water in a self contained tank. The amount of this resistance can be varied adding resistors in parallel with the motor windings, by increasing the volume of water or number of paddles, or otherwise. Note that in this particular embodiment the only connection between the exerciser and the resistance is the electrical force through the control box 23. This allows a bidirectional force to be utilized on the shaft 20 by switching the electrical lines to the motor 24. In other embodiments of the invention there may be a direct mechanical 25 interconnection between the exerciser and the resistance (perhaps including a torque rod or other lost motion interconnection to allow for an accurate load/work sensing irregardless of the presence of a feedback or resistance drive motor.) Again if this was done the functions of the motors 22 and 24 could be combined.

The feedback motor 22 connected to the bidirectional shaft 20 provides the exerciser with a sense of a resistance (to the extent that such resistance is not already being provided by the generator 21. Note that a reduced perceived load could also be provided by siphoning off part of the output of the generator 21—i.e. effectively driving no load with part of the output of the generator while an increased perceived load can be provided by loading down the generator. Feedback could thus be provided by the generator alone if desired). The feedback motor 22 also allows the perceived resistance to be increased or reduced as appropriate and/or desired (as previously discussed). The use of this feedback motor 22 provides for a finer control of the feedback to the exerciser than would be possible through the utilization of the generator 21 alone. This is especially so if a feedback sensor is utilized for a direct input and control of such resistance. The feedback motor 22 could also allow the exercise equipment to be utilized over a much greater range of resistance than would otherwise be possible. For example in a machine having a 100 pound maximum resistance, the feedback motor 22 could provide an extra 50 pounds of resistance thereby increasing the perceived workload available from a set machine. This allows one to optimize a machine for the broad range of average exercisers while also providing for the non-average individual (above or below). The power for the feedback motor 22 is normally provided by an external connection 28 to the control box 23. Note that the feedback motor 22 is normally applying a force opposite to the force of the exerciser on the bidirectional shaft 20. In this regard it is preferred that the feedback motor 22 be inoperative if the generator 21 is not producing a positive output (i.e. the exerciser is not in direct control of the force input into the machine). In addition a physical stop and/or cutoff switch would be included to prevent motion of the input shaft beyond a certain point so as to provide the exerciser with a position of no resistance. This would contribute to the exerciser's control of the exercising equipment.

Figure 4:
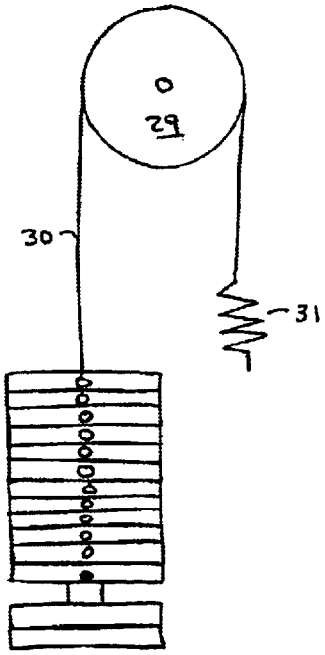
FIG. 4 is a partial view of the incorporation of the invention of the application into a Nautilus machine.
Figure 5:
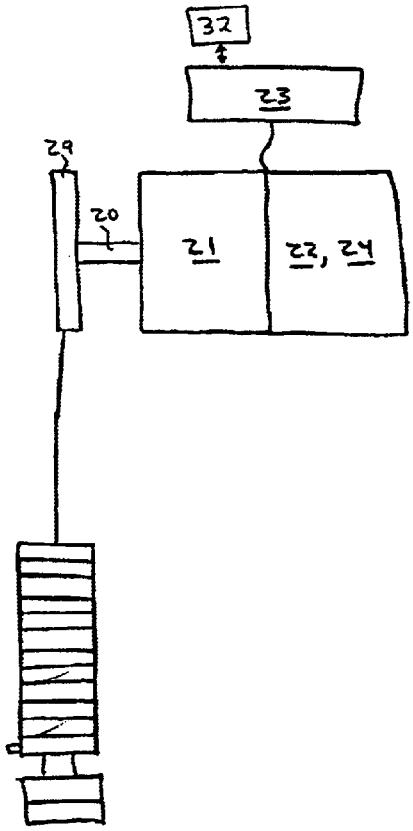
FIG. 5 is a side view of the partial view of FIG. 4.

The preferred embodiment of the invention can be used with preexisting resistance exercise equipment, a NAUTILUS machine for example, by incorporating a sprocket 29 on the end of the bidirectional input shaft 20 and connecting such sprocket 29 to the customary chain 30 from the NAUTILUS equipment (shown in FIGS. 4 and 5). In the event of an unidirectional force on the chain 30 (with the usual return spring 31), the control circuit 23 would preferably disconnect the generator 21, and feedback motor 22 from the shaft 20 so that there is no load on the return cycle against which the spring 31 must act. In the event of a bidirectional force on the chain 30, both sides of the chain would be normally active such that no return spring 31 would be necessary. In the preferred embodiment of this adaptation the resistance is provided by the NAUTILUS weights already in place on the machine. For this reason the feedback 22 and resistance 24 drive functions can be combined into a single motor. This motor is utilized to alter the resistance already in place by adding to or subtracting therefrom as previously discussed. The retention of the existing NAUTILUS weights has the advantage of allowing individual settings by hand if preferred by a particular exerciser. In keeping with the philosophy of a NAUTILUS machine, it is envisioned that the major application for the invention in such machines would be to alter the resistance such that the predetermined number of repetitions can be accomplished by the exerciser with a predetermined degree of difficulty. To accomplish this the control box 23 would normally determine the relative ease by which the exerciser accomplishes a particular repetition and then the control box 23 would increase or reduce the perceived resistance based on such a determination. In the simplest system the determination would be based by a comparison of the elapsed time (start to finish) for the repetition against a previously established time (i.e. quicker than such established time resistance increased, slower resistance lowered). In a much more sophisticated system (of this or other application of the invention) each individual exerciser would carry an electrically preprogrammed memory card 32 with such individual's own previous performance on each machine recorded on the card or on a central memory referencing such card (for example base resistance weight, speed for each repetition, feedback provided, etc.). Upon the exerciser putting the memory card 32 into the control box 23 for a particular machine or the machine otherwise sensing such card (for example proximity transmission cards), such machine would automatically set itself for that particular exerciser based on the exerciser's previous own workouts instead of any arbitrary values. This would, for example, allow an individual's own parameters to be utilized—i.e. an individual who starts off slow and finishes faster could be accommodated. In any event an override/alternate programming entry keyboard would allow any exerciser to have a direct input into any particular workout. Again in any event many parameters could be utilized to match the exercise to the individual.

Figure 2:
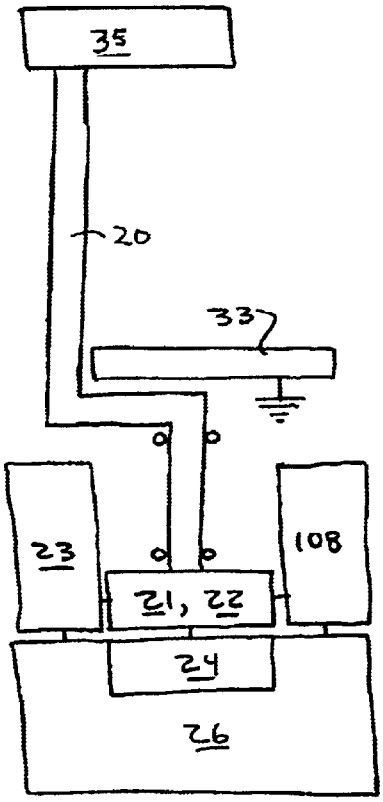
FIG. 2 is an abdominizer exercising machine incorporating the invention of the application.
Figure 3:
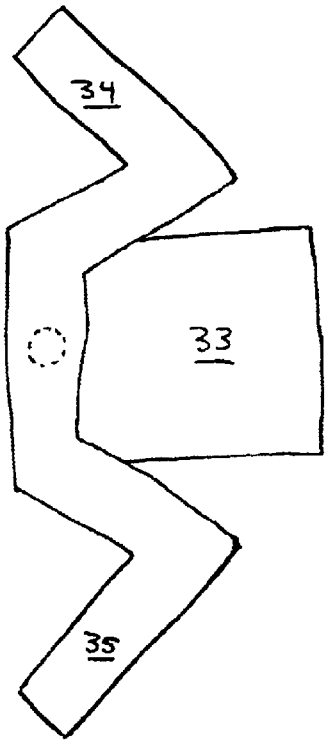
FIG. 3 is a top view of the abdominizer exercising machine of FIG. 2.

As Shown in FIGS. 2 and 3, the invention can be also utilized in specially designed equipment. This incorporation has the added advantages of small size in respect to existing exercise resistance NAUTILUS equipment. The particular configuration shown in FIGS. 2 and 3 is a rotary abdominal machine. In this machine a user sits on the seat 33 with his/her arms wrapped behind the two bent shaped arm pieces 34, 35. As the user rotates his/her upper body about the axis of the shaft 20, the shaft 20 is in turn rotated in a bidirectional manner to provide the input force for the loading and feedback mechanism of the invention of this present application. Note that the rotational axis of the shaft 20 of this particular machine is in line with the exerciser's spine. Note also that this particular incorporation of the invention provides other benefits as well. For example in the present NAUTILUS abdominal machine the user works against a constant weight load during each direction of rotation. The preferred NAUTILUS device of FIGS. 2 and 3 selectively provides for this and more. For example one can program the control box 23 to provide for an inertial quality. With this quality the exerciser would feel as if the machine was interconnected to a flywheel—i.e. the speed (and force) of an exerciser's movements would have a marked effect on the quality of exercise (by effectively allowing the exerciser to spread the resistance over any length of time at his/her option). This would enable one to have an aerobic exercise utilizing unique muscle group toning the muscle more expeditiously than NAUTILUS could in the NAUTILUS type equipment. It would also allow one to exercise a muscle group longer than with a within a NAUTILUS machine. Therefore in addition to altering the resistance, the invention also allows other benefits as well.

Figure 1:
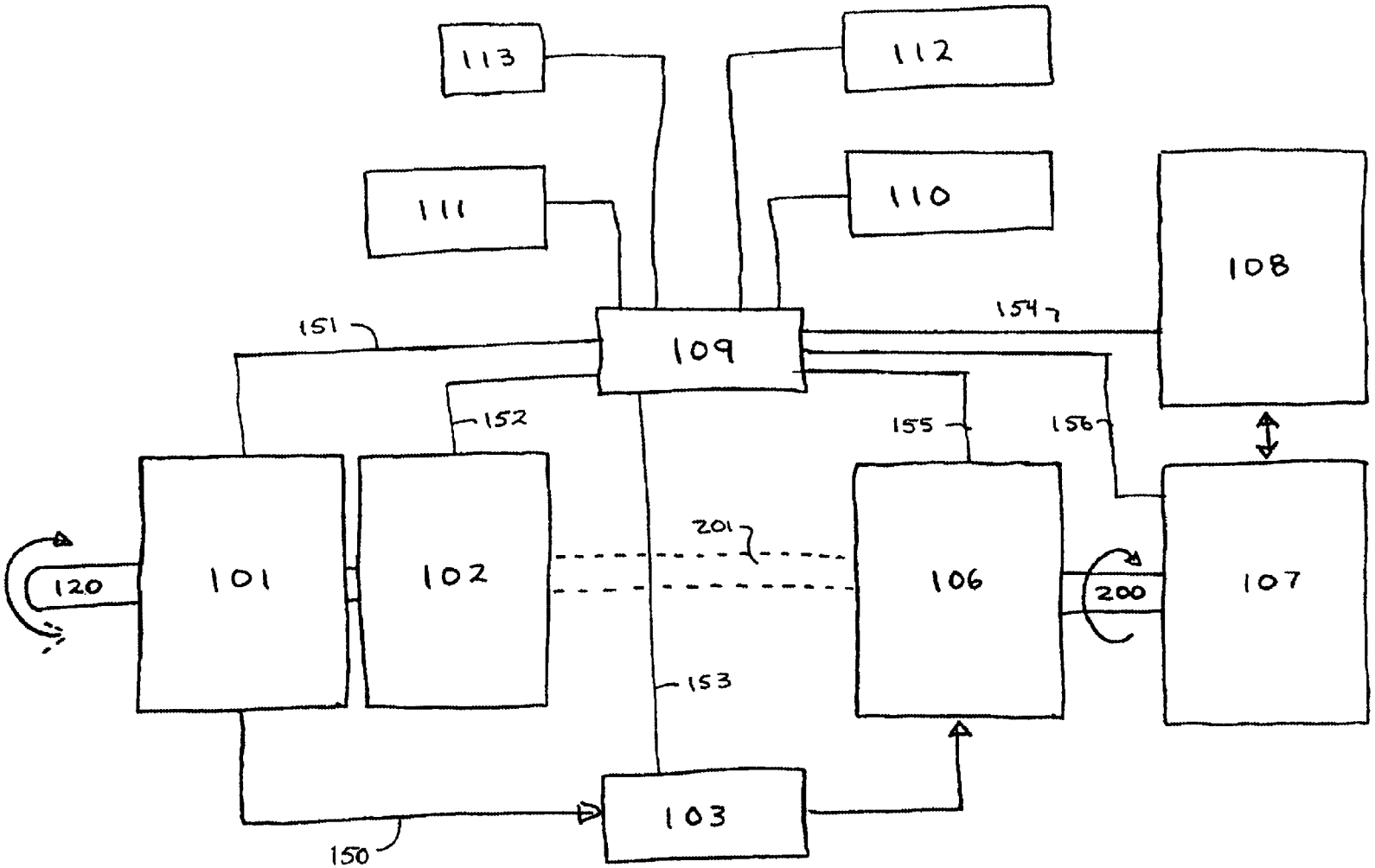
FIG. 1 is a schematic view of an exercising machine incorporating a preferred embodiment of the invention.

FIG. 1 discloses a preferred complete control circuit for the preferred embodiment of the invention. This embodiment includes an input generator 101, a feedback motor 102, a rectifier 103, a motor 106, a motor load 107, a ballast 108, a control circuit 109, a keyboard 110, a prom 111, a readout 112, and a heart monitor 113.

The generator 101 takes the forces of the input shaft 120 and converts such mechanical force into an electric output 150. This electric output is normally a sinesodal wave with the amplitude and frequency depending upon the forces input into the generator from the input shaft 120. The signal 150 representing the output of the generator is fed into the rectifier control 103. This rectifier converts the amplitude modulated signal 150 into a DC signal having an amplitude directly related to the power being applied on the input shaft 120 (a DC signal is preferred as being easier to control). In addition the sensed attributes from the generator 101 is fed into the control means 109 along line 151 for purposes later described. In the particular embodiment disclosed, the output of the AC generator is the same irregardless of which way the generator input 101 is rotated. For this reason the direction of rotation of the generator is also separately sensed and fed into the central processing unit 109 via a control line 151. The rectifier control 103 takes the direct current output of the generator 101 and modifies such output as needed for use by the motor 106. The amplitude (and frequency if AC) of the output of the rectifier control 103 is under the control again of the central processing unit 109 via the control line 153. The motor 106 rotates the load 107 by the physical connection of the shaft 200. It is preferred that the rotation of the motor 106 be unidirectional so as to present a constant force for the load. The amount of the load is varied via a ballast machine 108 which increases or decreases the load depending upon the power control line 154. The speed of rotation of the motor 106 and load 107 are separately sensed by lines 155 and 156.

The control central processing unit 109 itself has three other inputs and one other output. The first input is a keyboard 110 which allows an individual to preset the various modes for the operation of the device if desired. The second input is a prom control which has various preset parameters (including default/override settings if desired) utilized in the control of the various aspects of the invention. The third input is a heart monitor 113 or other physical condition sensor which allows the constant modification of the operating parameters of the device based on that individual's heart rate (or other direct parameter if desired). The readout 112 notifies the individual of the various operational modes of the machine as well as aiding in the initial setup thereof and providing feedback to the exerciser. The control unit 109 also actively modifies the feedback motor 102 as appropriate by line 152.

The use of the circuitry of the preferred embodiment of the invention as disclosed in FIG. 1 allows for many variations of an individual's exercise routine. For example in ordinary use the feedback motor 102 may be preset to establish a certain preload on the input shaft 120. An example of this preload would be a constant 100 pound reverse force. The individual who manipulated the input shaft would therefore have to overcome this force in the manipulation of the input shaft. The generator 101 would inform the central processing unit 109 of the speed and ease at which the user was successful in overcoming this constant force applied by the feedback motor. If the individual was working too quickly, the central processing unit 109 would increase the load. If on the other hand; the individual was having too tough a time, the central processing unit 109 would reduce the load. Examples of this have been previously described. The load modification could be occasioned by removing/adding to the generator's effective load, or by supplementing/detracting from the power going to the motor, or by changing the ballast. The former is preferred as being the most expeditious. Again if desired a direct mechanical connection 201 can be established between the input shaft 120 and shaft 200 driving the load 107. This would be appropriate, for example, in the case of exercise equipment such as a NAUTILUS machine. Note that with a direct mechanical connection to a load, the feedback motor 102 can be combined with the drive motor 106 (and even the generator 101 with appropriate modifications such as a torque differential sensor between the shaft 120 and 200) to either add to or detract from the effective load on the shaft 120 as necessary (i.e. the modification of the effective force provides both functions). Other examples of how the central processing unit 109 would control the apparatus of FIG. 1 has been previously described in respect to the other embodiments of the invention, all of which control parameters are possible through the use of the central processing unit 109.

Although this invention has been described in its preferred embodiment with a certain degree of particularity, it is to be understood that numerous changes can be made without deviating from the invention as hereinafter claimed.

What is claimed is:

1. In a resistance exercising machine having a presettable load resistance for use with a repetitive input of force exercise having an ascertainable parameter to the exercise other than the value of the load resistance, the improvement of a variable resistance means to vary the preset load resistance upwards or downwards, a control box means to automatically selectively alter said controllable variable resistance means in order to vary the effective load resistance upwards or downwards during the input of force to retain the exercise within the ascertainable parameter.

2. The improved resistance exercising machine of claim 1 wherein the exercise utilizes a series of multiple repetitions each having a segment and a time per repetition and characterized in that the ascertainable parameter is time per repetition for each segment.

3. The improved resistance exercising machine of claim 1 wherein the machine has bidirectional forces and characterized in that said control box means varies the effective resistance unsymmetrically in respect to the bidirectional forces.

4. The improved resistance exercising machine of claim 3 characterized in that said control box means substantially eliminates the resistance in one of the bidirectional forces.

5. The improved resistance exercising machine of claim 1 characterized by the addition of the previous preset load resistance for a particular exerciser being held in memory and in that said control box means includes a means to utilize said previous preset load resistance to automatically begin the new preset load resistance for that particular exerciser.

6. The improved resistance exercising machine of claim 5 characterized in that said memory is on an exchangeable card.

7. The improved resistance exercising machine of claim 5 characterized in that said memory is in a computer.

8. The resistance exercising machine of claim 1 wherein the presettable load resistance has a given inertial quality for a given setting during the input of force and characterized by the addition of means to artificially modify the inertial quality of the preset resistance at a given setting.

9. The resistance exercising machine of claim 1 characterized by said altering mechanism means including a generator and said generator varying the preset load resistance.

10. The resistance exercising machine of claim 1 characterized by the addition means to separate the preset load resistance from direct mechanical connection to the exerciser during the repetitive input of force exercise.

11. The resistance exercising machine of claim 1 characterized by said control box means including an initial range adjustment sensor for automatically setting the presettable load resistance at the start of the exercise.

12. The improved resistance exercising machine of claim 1 characterized in that each exerciser has a memory area associated therewith and said control box means utilizes said memory area to automatically selectively said controllable variable resistance.

13. The improved resistance exercising machine of claim 12 characterized in that said memory area is on a card.

14. The improved resistance exercising machine of claim 1 characterized in that there are a limited number of preset resistances.

15. The improved resistance exercising machine of claim 14 characterized in that there is a single preset load resistance.

16. The resistance exercising machine of claim 1 characterized by said control box means including a means to automatically modify the preset load resistance upwards or downwards based upon the time of initial repetition and thereafter retaining the preset resistance at a constant level.

17. The resistance exercising machine of claim 1 characterized by said control box means including a means to begin with a preset load resistance too high for the particular exerciser at the start of the exercise.

18. The improved resistance exercising machine of claim 1 characterized by the addition of sensor means to automatically identify the particular exerciser without exerciser input, and said control box means being responsive to said sensor means to initially set the preset load resistance at the start of the exercise.

19. A resistance exercising machine comprising a means to provide a repetitive input of force from an exerciser in an exercise, a resistance presenting a load having a set inertial quality for use with said repetitive input of force, a resistance varying means connected to said resistance, and a control box means to automatically selectively alter said resistance varying means to artificially modify the set inertial quality of the resistance during the exercise.

20. The improved resistance exercising machine of claim 19 wherein the exercise is bidirectional having a forward and return stroke and characterized by the addition of said control box means also artificially provides a different inertial quality to said resistance during the return stroke.

21. The improved resistance exercising machine of claim 19 wherein the exercise has multiple repetitions each with a segment and a time per repetition and characterized by the addition of a modifying means to automatically modify said resistance based upon the time per repetition for each segment.

22. The improved resistance exercising machine of claim 21 wherein said modifying means lowers said resistance upon increasing time per repetition.

23. The improved resistance exercising machine of claim 21 characterized in that said modifying means modifies said load resistance upwards and/or downwards based upon the time of initial repetition and thereafter retains said resistance at a constant level for substantially the time of the exercise.

24. The improved resistance exercising machine of claim 21 characterized in that said modifying means begins with said resistance too high for the particular exerciser at the start of the exercise.

25. The improved resistance exercising machine of claim 21 characterized by the addition of a previous said resistance for a time per repetition for a particular exerciser being held in memory and in that said modifying means utilizes said previous said resistance held in memory to automatically initially set the initial resistance for a subsequent exercise by that particular exerciser.

26. The improved resistance exercising machine of claim 25 characterized in that said memory is on an exchangeable card.

27. The improved resistance exercising machine of claim 25 characterized in that said memory is in a computer.

28. The improved resistance exerciser machine of claim 27 characterized by the addition of sensor means to identify the particular exerciser and said control box means being responsive to said sensor means to initially set said initial non-inertial load resistance.

29. In an exercise machine having a selectably variable resistance for use with a repetitive input of forces exercise having an ascertainable parameter to the exercise other than the value of the resistance, an improvement comprising the selectably variable resistance including a presettable fixed load, said presettable fixed load being substantially non-adjustable during the exercise, a modifying means to modify the selectably variable resistance upwards and/or downwards from the preset fixed load and a control box means to selectably vary said modifying means during input of force in order to retain the exercise within the ascertainable parameter without alteration of the presettable fixed load.

30. The exercise machine of claim 29 wherein the exercise utilizes a series of multiple repetitions each having a segment and a time per repetition and characterized in that the ascertainable parameter is time per repetition for each segment.

31. The exercise machine of claim 29 wherein the selectively variable resistance has substantially no inertial quality during the input of force characterized by the addition of means artificially to impart an inertial quality to the selectably variable resistance.

32. The exercise machine of claim 29 characterized in that said adjustment means includes a generator, and said generator varying the resistance.

33. The exercise machine of claim 29 characterized by the addition of means to separate the selectably variable resistance from direct mechanical connection to the exerciser.

34. The exercise machine of claim 29 characterized in that said adjustment means includes an initial range adjustment sensor to initially automatically set the selectably variable resistance.

35. The exercise machine of claim 29 characterized in that each exerciser has a memory area associated therewith and said automatic adjustment means utilizes said memory area.

36. The exercise machine of claim 35 characterized in that said memory area is on a card.

37. The exercise machine of claim 29 characterized in that the setting of the parameter for said control box means optimizes the exercise.

38. The exercise machine of claim 37 characterized in that the parameter for said control box means is ascertained empirically.

39. The exercise machine of 37 characterized in that the parameter for said control box means is ascertained theoretically.

40. The exercise machine of claim 29 wherein the exercise has multiple parameters and characterized in that said control box means optimizes the exercise in respect to the multiple parameters.

41. The exercise machine of claim 40 characterized in that the parameters vary during the duration of the exercise.

42. In an exercise machine having a selectably variable resistance for use with an exercise having an ascertainable parameter to the exercise, the improvement of an adjustment means to adjust the selectably variable resistance, a control box means to automatically selectively alter said adjustment means in order to retain the exercise within the ascertainable parameter, and the selectably variable resistance being a presettable physical weight pack having a multiplicity of given settings and said adjustment means include an override means to override a single given setting of the presettable weight pack upwards increasing the load and/or downwards decreasing the load from said single given setting.

43. The exercise machine of claim 42 characterized by the machine having bidirectional forces thereon and said override means varies the effective resistance unsymmetrically in respect to the bidirectional forces.

44. The exercise machine of claim 43 characterized in that said override means substantially eliminate the resistance in one of the bidirectional forces.

45. In an exercising machine for performing an exercise having a desired parameter, the improvement comprising a analog feedback indicator, and said analog feedback indicator directly indicating the degree of deviance from the desired parameter to inform the exerciser of the level of success in maintaining the desired rate of exercise and not the amount of time for performing the exercise.

46. The exercising machine of claim 45 characterized in that said analog feedback indicator is a tone with said tone varying depending on the degree of deviance.

47. The exercising machine of claim 45 characterized in that said analog readout is a string of lights and said string of lights varying upwards and/or downwards depending on the degree of deviance.

48. The exercising machine of claim 45 wherein the exercise machine has a resistance and characterized by the addition of a control box means to automatically vary the resistance upwards and/or downwards to meet the desired parameter if the exercise deviates therefrom by a certain predetermined amount.

49. In a resistance exercising machine having a presettable resistance for use with a repetitive input of force exercise, an improvement comprising the presettable resistance including a physical load having a given value, an adjustment means to alter the resistance during the exercise and a control box means to automatically selectively alter said adjustment means upwards increasing the resistance from the given value and/or downwards decreasing the resistance from the given value without altering the given value of the physical load so as to continually vary the resistance during the exercise.

50. The resistance exercising machine of claim 49 characterized by said control box means includes a means programmed with multiple preset values of alteration for a given unidirectional exercising movement.

51. The resistance exercise machine of claim 49 characterized in that said control box means includes a means set with values of alteration appropriate for a given individual.

52. The resistance exercise machine of claim 49 wherein the exercise has a parameter and characterized in that said adjustment means alters the resistance to override the physical load of the machine should the exercise deviate significantly from the parameter.

53. The resistance exercising machine of claim 49 wherein the exercise had desired parameters and characterized in that said altering control box means varies the resistance in order to keep the exercise within the desired parameters.

54. The resistance exercise machine of claim 49 characterized in that the resistance is a variable resistance and said adjustment means is a selectably controllable means for the variable resistance.

55. The resistance exercise machine of claim 49 characterized in that said adjustment means includes an altering mechanism.

56. The resistance exercise machine of claim 49 characterized in that said altering mechanism acts on said load.

57. The resistance exercise machine of claim 49 characterized in that the control box means generally increases the resistance during the exercise.

58. The resistance exercise machine of claim 49 characterized in that the control box means generally decreases the resistance during the exercise.

59. In a resistance exercise machine having a resistance set at a chosen value before initiation of the exercise, the resistance for use with a repetitive input of force exercise, an improvement comprising the resistance including a physical load having a given value, an adjustment means to alter the chosen value of the set resistance upwards increasing the resistance from the chosen value and/or downwards decreasing the resistance from the chosen value during the exercise without altering the given value of the physical load and a control box means to automatically selectively alter said adjustment means without exerciser intervention so as to vary the resistance perceived by the exerciser to other than the chosen value of the set resistance.

60. In a resistance exercise machine having a resistance set at a chosen value before initiation of the exercise, the resistance for use with a repetitive input of force exercise, there is a parameter to the exercise other than resistance or time per repetition, an improvement comprising the resistance including a physical load having a given value, an adjustment means to alter the chosen value of the set resistance intermediate the exercise without altering the given value of the physical load, a control box means to automatically selectively alter said adjustment means so as to vary the resistance perceived by the exerciser to other than the chosen value of the set resistance, a sensor, said sensor sensing the parameter, said sensor being connected to said control box to input data thereto and said control box having a means to alter said adjustment means based on the data from said sensor.

61. In a resistance exercise machine having a resistance set at a chosen value before initiation of the exercise, the resistance for use with a repetitive input of force exercise, the machine is utilized by differing exercisers each having a level of exercise, an improvement comprising the resistance including a physical load having a given value, an adjustment means to alter the chosen value of the set resistance during the exercise without altering the given value of the physical load, a control box means to automatically selectively alter said adjustment means so as to vary the resistance perceived by the exerciser to other than the chosen value of the set resistance, and a means for said control box to automatically alter said adjustment means without exerciser intervention to accommodate the level of exercise of each differing exerciser.

62. In a resistance exercise machine having a resistance set at a chosen value before initiation of the exercise, the resistance for use with a repetitive input of force exercise, an improvement comprising the resistance including a physical load having a given value, an adjustment means to alter the chosen value of the set resistance during the exercise without altering the given value of the physical load, a control box means to automatically selectively alter said adjustment means without exerciser intervention so as to vary the resistance perceived by the exerciser to other than the chosen value of the set resistance to allow the exerciser to exercise, and the set resistance is initially too high for the exerciser at the start of the exercise.

63. The exercise machine of claim 59 characterized in that the resistance is a non-inertial resistance and by the addition of means for said control box to alter said adjustment means to artificially provide an inertial quality to the non-inertial resistance.

64. The exercise machine of claim 59 characterized in that said control box is programmed with a desired exercise coefficient other than a continuing set value resistance.

65. A resistance exercise machine for use with an exercise utilizing a repetitive input of force, the machine comprising a controllable variable resistance, said controllable variable resistance including a load, said controllable variable resistance being drivingly connected to the repetitive input of force such that the force drives said load, a control box, said control box being connected to said controllable variable resistance and said control box automatically selectively altering said controllable variable resistance without exerciser intervention so as to continually vary said controllable variable resistance upwards and/or downwards during the input of force.

66. The resistance exercise machine of claim 65 characterized in that said control box alters said controllable variable resistance via an altering mechanism, and said altering mechanism being connected to said load.

67. A resistance exercise machine for use with a exercise utilizing a repetitive input off force, the machine comprising a controllable variable resistance, said controllable variable resistance including a load, said controllable variable resistance being drivingly connected to the repetitive input of force such that the force drives said load, a control box, said control box being connected to said controllable variable resistance, said control box automatically selectively altering said controllable variable resistance so as to continually vary said controllable variable resistance during the input of force, said load having a given inertial load under an application of force, a resistance altering means and said resistance altering means artificially modify the given inertial quality of said load during the repetitive input of force load.

68. The resistance exercising machine of claim 65 characterized in that said control box is programmed with the desired exercise coefficients for the exercise.

69. A resistance exercise machine for use with an exercise utilizing a repetitive input of force, the machine comprising a controllable variable resistance, said controllable variable resistance including a load, said controllable variable resistance being drivingly connected to the repetitive input of force such that the force drives said load, a control box, said control box being connected to said controllable variable resistance, said control box automatically selectively altering said controllable variable resistance so as to continually vary said controllable variable resistance during the input of force, a feedback indicator and said feedback indicator indicating the deviance of the exercise actually performed from the desired exercise coefficients.

* * * * *